United States Patent [19]

Sughrue, II et al.

[11] Patent Number: 4,715,948

[45] Date of Patent: Dec. 29, 1987

[54] IMPROVING THE LIFE OF A CATALYST USED TO PROCESS HYDROCARBON CONTAINING FEED STREAMS

[75] Inventors: Edward L. Sughrue, II; Simon G. Kukes; Robert J. Hogan, all of Bartlesville, Okla.

[73] Assignee: Phillips Petroleum Company, Bartlesville, Okla.

[21] Appl. No.: 581,458

[22] Filed: Feb. 17, 1984

Related U.S. Application Data

[63] Continuation-in-part of Ser. No. 511,078, Jul. 6, 1983, abandoned.

[51] Int. Cl.[4] ..... C10G 45/00; C03C 6/08

[52] U.S. Cl. ..... 208/251 H; 208/216 R; 208/254 H; 502/30; 502/31; 502/32

[58] Field of Search ..... 208/216 R, 251 H, 254 H; 502/30, 31, 32

[56] References Cited

U.S. PATENT DOCUMENTS 3,331,769 7/1967 Gatsis ..... 208/216 R 4,285,804 8/1981 Jacquin et al. ..... 208/216 R

*Primary Examiner*—Andrew Metz

*Assistant Examiner*—Chung K. Pak

*Attorney, Agent, or Firm*—Williams, Phillips & Umphlett

[57] ABSTRACT

In a hydrofining process, the life of a catalyst composition comprising a support selected from the group comprising alumina, silica and silica-alumina and a promoter comprising at least one metal selected from Group VIB, Group VIIB, and Group VIII of the periodic table is improved by mixing a decomposable compound of molybdenum with the hydrocarbon-containing feed stream prior to contacting the hydrocarbon-containing feed stream with the catalyst composition. The molybdenum in the decomposable compound is in valence state of zero. A sufficient quantity of the decomposable compound of molybdenum is added to the hydrocarbon-containing feed stream to result in a concentration of molybdenum in the range of about 1 to about 60 ppm. The introduction of the decomposable compound of molybdenum may be commenced when the catalyst is new, partially deactivated or spent with a beneficial result occurring in each case.

11 Claims, 4 Drawing Figures

Figure 1:
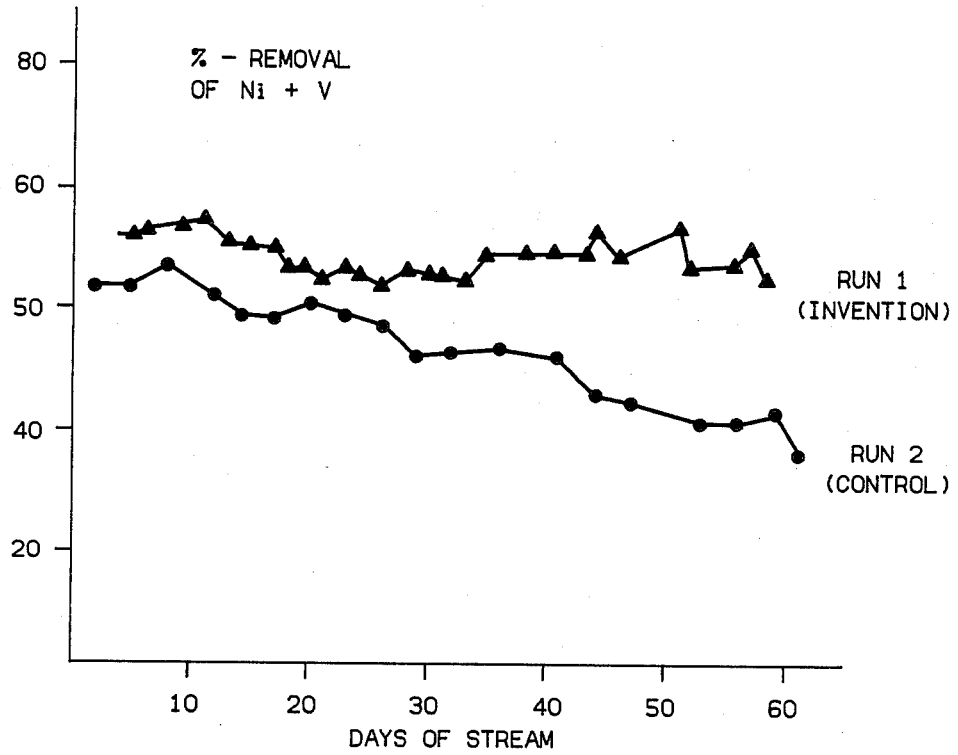

IMPROVING THE LIFE OF A CATALYST USED TO PROCESS HYDROCARBON CONTAINING FEED STREAMS

This application is a continuation-in-part of application Ser. No. 511,078 filed July 6, 1983, abandoned.

This invention relates to a process for improving the life of a catalyst used to process hydrocarbon-containing feed streams. In one aspect, this invention relates to a process for improving the life of a catalyst used to remove metals from a hydrocarbon-containing feed stream. In another aspect, this invention relates to a process for improving the life of a catalyst used to remove sulfur from a hydrocarbon-containing feed stream. In still another aspect, this invention relates to a process for improving the life of a catalyst used to remove potentially cokeable components from a hydrocarbon-containing feed stream. In still another aspect, this invention relates to a process for improving the life of a catalyst used to reduce the amount of heavies in a hydrocarbon-containing feed stream.

As used herein, the term "life of a catalyst" refers to the period of time that a catalyst will maintain an acceptable activity. Typically, when the activity of a catalyst drops to unacceptable levels, the catalyst must be replaced or regenerated. Longer lifetimes of catalyst are extremely desirable from both a process viewpoint and an economic viewpoint.

It is well known that crude oil as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalysts employed in processes such as catalytic cracking, hydrogenation or hydrodesulfurization.

The presence of other components such as sulfur and nitrogen is also considered detrimental to the processability of a hydrocarbon-containing feed stream. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur and nitrogen and components which have a tendency to produce coke.

It is also desirable to reduce the amount of heavies in the heavier fractions such as the topped crude and residuum. As used herein the term heavies refers to the fraction having a boiling range higher than about 1000° F. This reduction results in the production of lighter components which are of higher value and which are more easily processed.

Catalysts are available which can be used to accomplish the removal of metals, sulfur, nitrogen, and Ramsbottom carbon residue and the reduction in heavies in processes which are generally referred to as hydrofining processes (one or all of the above described removals and reduction may be accomplished in a hydrofining process depending on the components contained in the hydrocarbon-containing feed stream). However, it is desirable to improve the life of such catalyst for such removal or reduction.

It is thus an object of this invention to provide a process for improving the life of a catalyst used in a hydrofining process to remove components such as metals, sulfur, nitrogen and Ramsbottom carbon residue from a hydrocarbon-containing feed stream and to reduce the amount of heavies in the hydrocarbon-containing feed stream. Such improvement provides substantial benefits since the catalyst may be used for a longer period of time without the necessity of regeneration or replacement of the catalyst and, in some cases, a higher initial activity of the catalyst for such removal and reduction is observed.

In accordance with the present invention, a hydrocarbon-containing feed stream, which also contains metals, sulfur, nitrogen and/or Ramsbottom carbon residue, is contacted with a solid catalyst composition comprising alumina, silica or silica-alumina. The catalyst composition also contains at least one metal selected from Group VIB, Group VIIB, and Group VIII of the Periodic Table, in the oxide or sulfide form. At least one decomposable compound of molybdenum, having a valence state of zero, is mixed with the hydrocarbon-containing feed stream prior to contacting the hydrocarbon-containing feed stream with the catalyst composition. The hydrocarbon-containing feed stream, which also contains molybdenum, is contacted with the catalyst composition in the presence of hydrogen under suitable hydrofining conditions. After being contacted with the catalyst composition, the hydrocarbon-containing feed stream will contain a significantly reduced concentration of metals, sulfur, nitrogen and Ramsbottom carbon residue as well as a reduced amount of heavy hydrocarbon components. Removal of these components from the hydrocarbon-containing feed stream in this manner provides an improved processability of the hydrocarbon-containing feed stream in processes such as catalytic cracking, hydrogenation or further hydrodesulfurization. Use of the molybdenum results in improved catalyst life and improved initial activity.

The decomposable compound of molybdenum may be added when the catalyst composition is fresh or at any suitable time thereafter. As used herein, the term "fresh catalyst" refers to a catalyst which is new or which has been reactivated by known techniques. The activity of fresh catalyst will generally decline as a function of time if all conditions are maintained constant. Introduction of the decomposable compound of molybdenum will slow the rate of decline from the time of introduction and in some cases will dramatically improve the activity of an at least partially spent or deactivated catalyst from the time of introduction.

For economic reasons it is sometimes desirable to practice the hydrofining process without the addition of a decomposable compound of moluybdenum until the catalyst activity declines below an acceptable level. In some cases, the activity of the catalyst is maintained constant by increasing the process temperature. The decomposable compound of molybdenum is added after the activity of the catalyst has dropped to an unacceptable level and the temperature cannot be raised further without adverse consequences. Addition of the decomposable compound of molybdenum at this point results in a drammatic increase in catalyst activity as will be illustrated more fully in Example VII.

Other objects and advantages of the invention will be apparent from the foregoing brief description of the invention and the appended claims as well as the detailed description of the invention which follows.

The catalyst composition used in the hydrofining process to remove metals, sulfur, nitrogen and Ramsbottom carbon residue and to reduce the concentration of heavies comprises a support and a promoter. The support comprises alumina, silica or silica-alumina. Suitable supports are believed to be $Al_2O_3$, $SiO_2$, $Al_2O_3$-$SiO_2$, $Al_2O_3$-$TiO_2$, $Al_2O_3$-$P_2O_5$, $Al_2O_3$-$SnO_2$ and $Al_2O_3$-ZnO. Of these supports, $Al_2O_3$ is particularly preferred.

The promoter comprises at least one metal selected from the group consisting of the metals of Group VIB, Group VIIB, and Group VIII of the Periodic Table. The promoter will generally be present in the catalyst composition in the form of an oxide or sulfide. Particularly suitable promoters are iron, cobalt, nickel, tungsten, molybdenum, chromium, manganese, vanadium and platinum. Of these promoters, cobalt, nickel, molybdenum and tungsten are the most preferred. A particularly preferred catalyst composition is $Al_2O_3$ promoted by CoO and $MoO_3$ or promoted by CoO, NiO and $MoO_3$.

Generally, such catalysts are commercially available. The concentration of cobalt oxide in such catalysts is typically in the range of about 0.5 weight percent to about 10 weight percent based on the weight of the total catalyst composition. The concentration of molybdenum oxide is generally in the range of about 2 weight percent to about 25 weight percent based on the weight of the total catalyst composition. The concentration of nickel oxide in such catalysts is typically in the range of about 0.3 weight percent to about 10 weight percent based on the weight of the total catalyst composition. Pertinent properties of four commercial catalysts which are believed to be suitable are set forth in Table I.

TABLE I

| Catalyst | CoO (Wt. %) | $MoO_3$ (Wt. %) | NiO (Wt. %) | Bulk Density* (g/cc) | Surface Area ($M^2/g$) |
|---|---|---|---|---|---|
| Shell 344 | 2.99 | 14.42 | — | 0.79 | 186 |
| Katalco 477 | 3.3 | 14.0 | — | .64 | 236 |
| KF - 165 | 4.6 | 13.9 | — | .76 | 274 |
| Commercial Catalyst D Harshaw Chemical Company | 0.92 | 7.3 | 0.53 | — | 178 |

*Measured on 20/40 mesh particles, compacted.

The catalyst composition can have any suitable surface area and pore volume. In general, the surface area will be in the range of about 2 to about 400 $m^2/g$, preferably about 100 to about 300 $m^2/g$, while the pore volume will be in the range of 0.1 to 4.0 cc/g, preferably about 0.3 to about 1.5 cc/g.

Presulfiding of the catalyst is preferred before the catalyst is initially used. Many presulfiding procedures are known and any conventional presulfiding procedure can be used. A preferred presulfiding procedure is the following two step procedure.

The catalyst is first treated with a mixture of hydrogen sulfide in hydrogen at a temperature in the range of about 175° C. to about 225° C., preferably about 205° C. The temperature in the catalyst composition will rise during this first presulfiding step and the first presulfiding step is continued until the temperature rise in the catalyst has substantially stopped or until hydrogen sulfide is detected in the effluent flowing from the reactor. The mixture of hydrogen sulfide and hydrogen preferably contains in the range of about 5 to about 20 percent hydrogen sulfide, preferably about 10 percent hydrogen sulfide.

The second step in the preferred presulfiding process consists of repeating the first step at a temperature in the range of about 350° C. to about 400° C., preferably about 370° C., for about 2–3 hours. It is noted that other mixtures containing hydrogen sulfide may be utilized to presulfide the catalyst. Also the use of hydrogen sulfide is not required. In a commercial operation, it is common to utilize a light naphtha containing sulfur to presulfide the catalyst.

As has been previously stated, the present invention may be practiced when the catalyst is fresh or the addition of the decomposable compound of molybdenum may be commenced when the catalyst has been partially deactivated. The addition of the decomposable compound of molybdenum may be delayed until the catalyst is considered spent.

In general, a "spent catalyst" refers to a catalyst which does not have sufficient activity to produce a product which will meet specifications, such as maximum permissible metals content, under available refinery conditions. For metals removal, a catalyst which removes less than about 50% of the metals contained in the feed is generally considered spent.

A spent catalyst is also sometimes defined in terms of metals loading (nickel+vanadium). The metals loading which can be tolerated by different catalyst varies but a catalyst whose weight has increased about 12% due to metals (nickel+vanadium) is generally considered a spent catalyst.

Any suitable hydrocarbon-containing feed stream may be hydrofined using the above described catalyst composition in accordance with the present invention. Suitable hydrocarbon-containing feed streams include petroleum products, coal, pyrolyzates, products from extraction and/or liquefaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy topped crudes and residuum and other materials which are generally regarded as too heavy to be distilled. These materials will generally contain the highest concentrations of metals, sulfur, nitrogen and Ramsbottom carbon residues.

It is believed that the concentration of any metal in the hydrocarbon-containing feed stream can be reduced using the above described catalyst composition in accordance with the present invention. However, the present invention is particularly applicable to the removal of vanadium, nickel and iron.

The sulfur which can be removed using the above described catalyst composition in accordance with the present invention will generally be contained in organic sulfur compounds. Examples of such organic sulfur compounds include sulfides, disulfides, mercaptans, thiophenes, benzylthiophenes, dibenzylthiophenes, and the like.

The nitrogen which can be removed using the above described catalyst composition in accordance with the present invention will also generally be contained in organic nitrogen compounds. Examples of such organic nitrogen compounds include amines, diamines, pyridines, quinolines, porphyrins, benzoquinolines and the like.

While the above described catalyst composition is effective for removing some metals, sulfur, nitrogen and Ramsbottom carbon residue, the life and efficiency of the catalyst composition can be significantly improved in accordance with the present invention by introducing a suitable decomposable molybdenum compound, where the molybdenum is in a valence state of zero, into the hydrocarbon-containing feed stream prior to contacting the hydrocarbon containing feed stream with the catalyst composition. As has been previously stated, the introduction of the decomposable compound of molybdenum may be commenced when the catalyst is new, partially deactivated or spent with a beneficial result occurring in each case. Suitable molybdenum compounds include $Mo(CO)_6$(molybdenum hexacarbonyl), $C_7H_8Mo(CO)_4$ (2,2,1-bicyclohepta-2,5-diene molybdenum tetracarbonyl), $[(C_5H_5)Mo(CO)_3]_2$ (cyclopentadienyl molybdenum tricarbonyl dimer), $[(CH_3)_3C_6H_3]Mo(CO)_3$ (mesitylene molybdenum tricarbonyl), $[CH_3C_5H_4Mo(CO)_3]_2$ (methylcyclopentadienyl molybdenum tricarbonyl dimer), $C_7H_8Mo(CO)_3$ (cycloheptatriene molybdenum tricarbonyl). Molybdenum hexacarbonyl is a particularly preferred additive.

It is believed, based on tests which will be discussed hereinafter, that molybdenum compounds, where the molybdenum is in a positive valence state, particularly four or more, are not effective in improving catalyst performance. Zero-valence molybdenum compounds, particularly $Mo(CO)_6$, are effective in improving catalyst performance.

Any suitable concentration of the molybdenum additive may be added to the hydrocarbon-containing feed stream. In general, a sufficient quantity of the additive will be added to the hydrocarbon-containing feed stream to result in a concentration of molybdenum metal in the range of about 1 to about 60 ppm and more preferably in the range of about 2 to about 30 ppm.

High concentrations such as about 100 ppm and above, particularly about 360 ppm and above, should be avoided to prevent plugging of the reactor. It is noted that one of the particular advantages of the present invention is the very small concentrations of molybdenum which result in a significant improvement. This substantially improves the economic viability of the process.

After the molybdenum additive has been added to the hydrocarbon-containing feed stream for a period of time, it has been found that only periodic introduction of the additive is required to maintain the efficiency of the process.

The molybdenum compound may be combined with the hydrocarbon-containing feed stream in any suitable manner. The molybdenum compound may be mixed with the hydrocarbon-containing feed stream as a solid or liquid or may be dissolved in a suitable solvent (preferably an oil) prior to introduction into the hydrocarbon-containing feed stream. Any suitable mixing time may be used. However, it is believed that simply injecting the molybdenum compound into the hydrocarbon-containing feed stream is sufficient. No special mixing equipment or mixing period are required.

The pressure and temperature at which the molybdenum compound is introduced into the hydrocarbon-containing feed stream is not thought to be critical. However, a temperature below 450° C. is recommended.

The hydrofining process can be carried out by means of any apparatus whereby there is achieved a contact of the catalyst composition with the hydrocarbon containing feed stream and hydrogen under suitable hydrofining conditions. The hydrofining process is in no way limited to the use of a particular apparatus. The hydrofining process can be carried out using a fixed catalyst bed, fluidized catalyst bed or a moving catalyst bed. Presently preferred is a fixed catalyst bed.

Any suitable reaction time between the catalyst composition and the hydrocarbon-containing feed stream may be utilized. In general, the reaction time will range from about 0.1 hours to about 10 hours. Preferably, the reaction time will range from about 0.3 to about 5 hours. Thus, the flow rate of the hydrocarbon containing feed stream should be such that the time required for the passage of the mixture through the reactor (residence time) will preferably be in the range of about 0.3 to about 5 hours. This generally requires a liquid hourly space velocity (LHSV) in the range of about 0.10 to about 10 cc of oil per cc of catalyst per hour, preferably from about 0.2 to about 3.0 cc/cc/hr.

The hydrofining process can be carried out at any suitable temperature. The temperature will generally be in the range of about 150° to about 550° C. and will preferably be in the range of about 350° to about 450° C. Higher temperatures do improve the removal of metals but temperatures should not be utilized which will have adverse effects on the hydrocarbon-containing feed stream, such as coking, and also economic considerations must be taken into account. Lower temperatures can generally be used for lighter feeds.

Any suitable hydrogen pressure may be utilized in the hydrofining process. The reaction pressure will generally be in the range of about atmospheric to about 10,000 psig. Preferably, the pressure will be in the range of about 500 to about 3,000 psig. Higher pressures tend to reduce coke formation but operation at high pressure may have adverse economic consequences.

Any suitable quantity of hydrogen can be added to the hydrofining process. The quantity of hydrogen used to contact the hydrocarbon-containing feed stock will generally be in the range of about 100 to about 20,000 standard cubic feet per barrel of the hydrocarbon-containing feed stream and will more preferably be in the range of about 1,000 to about 6,000 standard cubic feet per barrel of the hydrocarbon-containing feed stream.

In general, the catalyst composition is utilized until a satisfactory level of metals removal fails to be achieved even with the addition of a decomposable compound of molybdenum. It is possible to remove the metals from the catalyst composition by certain leaching procedures but these procedures are expensive and it is generally contemplated that once the removal of metals falls below a desired level, the used catalyst will simply be replaced by a fresh catalyst.

The time in which the catalyst composition will maintain its activity for removal of metals will depend upon the metals concentration in the hydrocarbon-containing feed streams being treated. It is believed that the catalyst composition may be used for a period of time long enough to accumulate 10–200 weight percent of metals, mostly Ni, V, and Fe, based on the weight of the catalyst composition, from oils.

The following examples are presented in further illustration of the invention.

EXAMPLE I

In this example, the automated experimental setup for investigating the demetallization and desulfurization of heavy oils in accordance with the present invention is described. Oil, with or without a dissolved decomposable molybdenum compound, was pumped downward through an induction tube into a trickle bed reactor, 28.5 inches long and 0.75 inches in diameter. The oil pump used was a Whitey Model LP 10 (a reciprocating pump with a diaphragm-sealed head; marketed by Whitey Corp., Highland Heights, Ohio). The oil induction tube extended into a catalyst bed (located about 3.5 inches below the reactor top) comprising a top layer of 50 cc of low surface area α-alumina (Alundum; surface area less than 1 $m^2$/gram; marketed by Norton Chemical Process Products, Akron, Ohio), a middle layer of 50 cc of a hydrofining catalyst and a bottom layer of 50 cc of α-alumina.

Hydrogen gas was introduced into the reactor through a tube that concentrically surrounded the oil induction tube but extended only as far as the reactor top. The reactor was heated with a Thermcraft (Winston-Salem, N.C.) Model 211 3-zone furnace. The reactor temperature was measured in the catalyst bed at three different locations by three separate thermocouples embedded in an axial thermocouple well (0.25 inch outer diameter). The liquid product oil was generally collected every day for analysis. The hydrogen gas was vented. Vanadium and nickel contents were determined by plasma emission analysis; sulfur content was measured by X-ray fluorescence spectrometry; and Ramsbottom carbon residue was determined in accordance with ASTM D524.

Undiluted heavy oil was used as the feed, either a Monagas pipeline oil or an Arabian heavy oil. In all demetallization runs the reactor temperature was about 407° C. (765° F.); the liquid hourly space velocity (LHSV) of the oil feed was about 1.0 cc/cc catalyst/hr; the total pressure was about 2250 psig; and the hydrogen feed rate was about 4800 SCF/bbl (standard cubic feet of the hydrogen per barrel of oil).

The decomposable molybdenum compound used, generally solid $Mo(CO)_6$ or liquid molybdenum octoate, were mixed in the feed by placing a desired amount in a steel drum of 55 gallons capacity, filling the drum with the feed oil having a temperature of about 160° F., and circulating oil plus additive for about two days with a circulatory pump for complete mixing. The resulting mixture was supplied through the oil induction tube to the reactor when desired.

EXAMPLE II

In this example, the effects of a decomposable molybdenum compound, $Mo(CO)_6$ (marketed by Aldrich Chemical Company, Milwaukee, Wis.), on the removal of metals, sulfur and Ramsbottom carbon from the oil is described. The hydrofining catalyst used was a fresh, commercial, promoted desulfurization catalyst (referred to as catalyst D in table I) marketed by Harshaw Chemical Company, Beachwood, Ohio. The catalyst had an $Al_2O_3$ support having a surface area of 178 $m^2$/g (determined by BET method using $N_2$ gas), a medium pore diameter of 140 Å and at total pore volume of 0.682 cc/g (both determined by mercury porosimetry in accordance with the procedure described by American Instrument Company, Silver Springs, Md., catalog number 5-7125-13. The catalyst contained 0.92 weight-% Co (as cobalt oxide), 0.53 weight-% Ni (as nickel oxide); 7.3 weight-% Mo (as molybdenum oxide).

The catalyst was presulfided as follows. A heated tube reactor was filled with an 8 inch high bottom layer of Alundum, a 7–8 inch high middle layer of catalyst D, and an 11 inch top layer of Alundum. The reactor was purged with nitrogen and then the catalyst was heated for one hour in a hydrogen stream to about 400° F. Whereall the reactor temperature was maintained at about 400° F., the catalyst was then exposed to a mixture of hydrogen (0.46 scfm) and hydrogen sulfide (0.049 scfm) for about two hours. The catalyst was then heated for about one hour in the mixture of hydrogen and hydrogen sulfide to a temperature of about 700° F. The reactor temperature was then maintained at 700° F. for two hours while the catalyst continued to be exposed to the mixture of hydrogen and hydrogen sulfide. The catalyst was then allowed to cool to ambient temperature conditions in the mixture of hydrogen and hydrogen sulfide and was finally purged with nitrogen.

The heavy oil feed was a Monagas pipeline oil containing about 87 ppm Ni, 336 ppm V, 42 ppm Fe, 11.41 weight-% Ramsbottom carbon residue, 2.72 weight-% S. Process conditions are listed in Example I. Run 1 employed a feed oil to which initially 17 ppm Mo (as $Mo(CO)_6$) was added. The amount of $Mo(CO)_6$ was gradually reduced during a 58 day run to a final content of 4 ppm Mo. The molybdenum content in the product oil fluctuated in a random manner but in most measurements the Mo level in the product oil was less than 1 ppm. Data are tabulated in Table II. Control Run 2 employed the same feed oil and catalyst; however, no $Mo(CO)_6$ was added to the oil. Test results are summarized in Table III.

TABLE II

| | | (Run 1)[1] | | | | | | | |
|---|---|---|---|---|---|---|---|---|---|
| | | Amount in Product Oil[2] | | | | | | | |
| Days on Stream | PPM Mo in Feed | Ni (PPM) | V (PPM) | Ni + V (PPM) | S (Wt. %) | Rams. C (Wt. %) | % Removal of Ni + V | % Removal of S | % Removal of Rams. C |
| 5 | 17 | 32 | 86 | 118 | 0.72 | 7.39 | 72 | 74 | 35 |
| 6 | 17 | 30 | 86 | 116 | 0.80 | 7.07 | 73 | 71 | 38 |
| 9 | 17 | 29 | 81 | 110 | 0.85 | 7.78 | 74 | 69 | 32 |
| 11 | 17 | 28 | 76 | 104 | 0.91 | 8.21 | 75 | 66 | 28 |
| 13 | 17 | 34 | 87 | 121 | 0.92 | 7.96 | 71 | 66 | 30 |
| 15 | 7 | 35 | 90 | 125 | 1.01 | 8.42 | 70 | 63 | 26 |
| 17 | 7 | 36 | 89 | 125 | 1.03 | 8.28 | 70 | 62 | 27 |
| 18 | 7 | 39 | 101 | 140 | 1.12 | 8.64 | 67 | 59 | 24 |
| 19 | 7 | 40 | 100 | 140 | 1.11 | 8.51 | 67 | 59 | 25 |
| 21 | 7 | 42 | 108 | 150 | 1.07 | 7.79 | 65 | 61 | 32 |
| 23 | 7 | 40 | 98 | 138 | 1.02 | 7.70 | 67 | 62 | 33 |
| 24 | 7 | 41 | 103 | 144 | 1.10 | 8.09 | 66 | 60 | 29 |
| 26 | 7 | 46 | 107 | 153 | 1.20 | 7.79 | 64 | 56 | 32 |
| 28 | 7 | 41 | 98 | 139 | — | — | 67 | — | — |

TABLE II-continued

| Days on Stream | PPM Mo in Feed | (Run 1)[1] Amount in Product Oil[2] Ni (PPM) | V (PPM) | Ni + V (PPM) | S (Wt. %) | Rams. C (Wt. %) | % Removal of Ni + V | % Removal of S | % Removal of Rams. C |
|---|---|---|---|---|---|---|---|---|---|
| 30 | 7 | 34 | 107 | 142 | 1.11 | — | 66 | 59 | — |
| 31 | 7 | 35 | 110 | 145 | 1.13 | — | 66 | 58 | — |
| 33 | 7 | 37 | 109 | 146 | 1.15 | 7.64 | 65 | 58 | 33 |
| 35 | 7 | 33 | 98 | 131 | 1.13 | 8.32 | 69 | 58 | 27 |
| 38 | 7 | 32 | 96 | 128 | 1.12 | 7.93 | 70 | 59 | 30 |
| 41 | 7 | 33 | 96 | 125 | 1.16 | 7.85 | 70 | 57 | 31 |
| 43 | 7 | 36 | 97 | 133 | 1.07 | 7.63 | 69 | 61 | 33 |
| 44 | 7 | 33 | 80 | 113 | 1.10 | 7.80 | 73 | 60 | 32 |
| 46 | 7 | 35 | 97 | 132 | 1.17 | 7.91 | 69 | 57 | 31 |
| 51 | 7 | 32 | 78 | 110 | 1.12 | 7.76 | 74 | 59 | 32 |
| 52 | 7 | 40 | 102 | 142 | 1.46 | 8.44 | 66 | 46 | 26 |
| 56 | 4 | 40 | 101 | 141 | 1.32 | 8.42 | 67 | 51 | 26 |
| 57 | 4 | 37 | 92 | 129 | 1.23 | 7.81 | 70 | 55 | 32 |
| 58 | 4 | 42 | 108 | 150 | 1.25 | 8.06 | 65 | 54 | 29 |

[1]Invention run; LHSV of the oil feed ranged from 0.96 to 1.08 cc/cc catalyst/hr; temperature was about 765° F. (407° C.), pressure was about 2250 psig; hydrogen feed rate was about 4800 SCF/barrel oil; catalyst was presulfided Catalyst D.
[2]Product oil also contained some Mo; in 19 of the 28 samples Mo content was <1.0 ppm; in six samples the Mo content ranged from 1–9 ppm; and in three samples the Mo content was >20 ppm (the analyses for these three samples are believed to have been erroneous).

TABLE III

| Days on Stream | PPM Mo in Feed | (Run 2)[1] Amount in Product Oil[2] Ni (PPM) | V (PPM) | Ni + V (PPM) | S (Wt. %) | Rams. C (Wt. %) | % Removal of Ni + V | % Removal of S | % Removal of Rams. C |
|---|---|---|---|---|---|---|---|---|---|
| 2 | 0 | 40 | 113 | 153 | 1.02 | 8.65 | 64 | 62 | 24 |
| 5 | 0 | 39 | 114 | 153 | 0.91 | — | 64 | 67 | — |
| 8 | 0 | 35 | 106 | 141 | 0.88 | 8.03 | 67 | 68 | 30 |
| 12 | 0 | 44 | 116 | 160 | 0.91 | 8.20 | 62 | 67 | 28 |
| 14 | 0 | 44 | 129 | 173 | 0.96 | 8.32 | 59 | 65 | 27 |
| 17 | 0 | 43 | 131 | 174 | 0.99 | 8.32 | 59 | 64 | 27 |
| 20 | 0 | 42 | 123 | 165 | 0.98 | 8.11 | 61 | 64 | 29 |
| 23 | 0 | 43 | 131 | 173 | 1.05 | 8.41 | 59 | 61 | 26 |
| 26 | 0 | 42 | 135 | 177 | 1.24 | 8.84 | 58 | 54 | 23 |
| 29 | 0 | 50 | 151 | 201 | 1.16 | 8.56 | 52 | 57 | 25 |
| 32 | 0 | 49 | 150 | 199 | 1.23 | — | 53 | 55 | — |
| 36 | 0 | 51 | 142 | 193 | — | — | 54 | — | — |
| 41 | 0 | 50 | 151 | 201 | 1.32 | 9.05 | 52 | 51 | 21 |
| 44 | 0 | 58 | 170 | 228 | 1.40 | 8.84 | 46 | 49 | 23 |
| 47 | 0 | 61 | 182 | 234 | 1.49 | 9.04 | 45 | 45 | 21 |
| 50 | 0 | — | — | — | 1.74 | 9.90 | — | 36 | 13 |
| 53 | 0 | 56 | 193 | 249 | — | — | 41 | — | — |
| 56 | 0 | 57 | 194 | 251 | 1.93 | 10.59 | 41 | 29 | 7 |
| 59 | 0 | 57 | 185 | 242 | 1.93 | — | 43 | 29 | — |
| 61 | 0 | 59 | 210 | 269 | — | — | 36 | — | — |

[1]Control run without $Mo(CO)_6$; LHSV of the oil feed ranged from 0.96 to 1.04 cc/cc catalyst/hr; temperature was about 765° F. (407° C.); pressure was about 2250 psig; hydrogen feed rate was about 4800 SCF/barrel oil; catalyst was presulfided Catalyst D.
[2]See footnote [2] of Table II.

Figure 2:
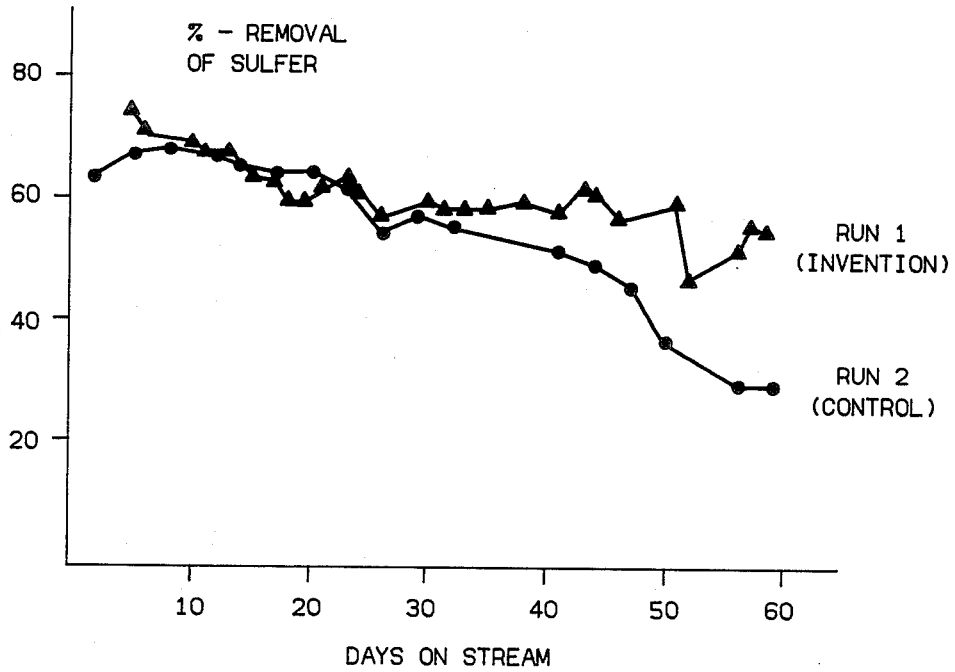
Figure 3:
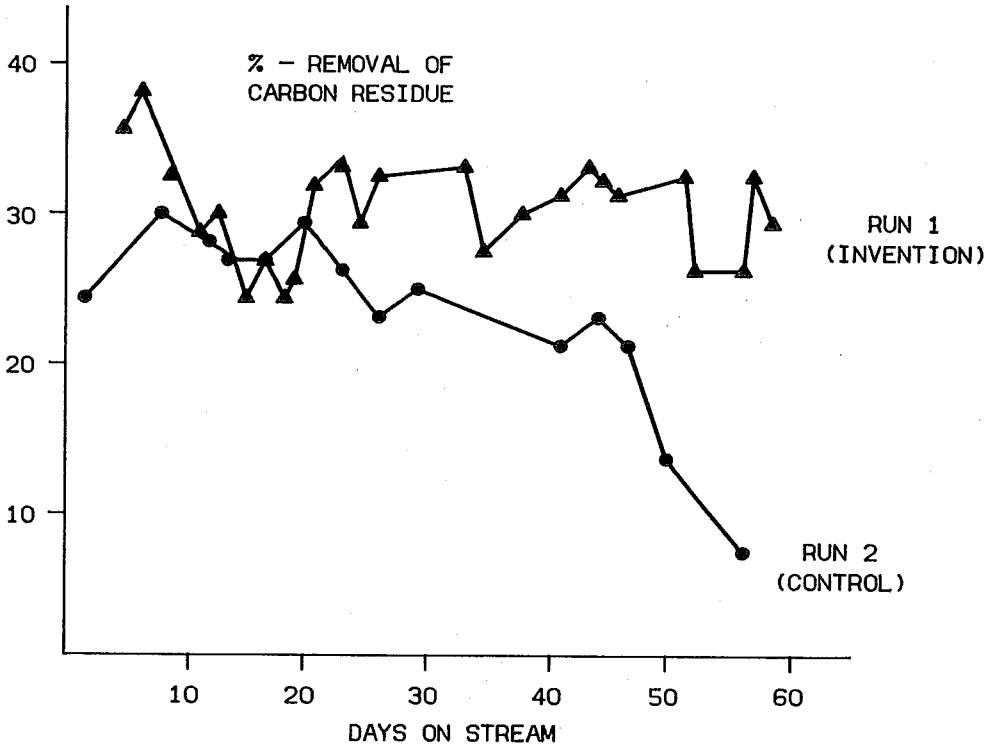

Data on metal (Ni+V) removal, sulfur removal and Ramsbottom carbon removal from oil listed in Tables II and III by catalytic hydrotreatment with or without small amounts of dissolved $Mo(CO)_6$ are plotted in FIGS. 1, 2 and 3. These figures clearly show that, unexpectedly, the promoted catalyst retained its activity (in terms of metal, sulfur and Ramsbottom carbon residue removal) much longer when $Mo(CO)_6$ was present in the feed (run 1) than in the absence of $Mo(CO)_6$ (run 2). In addition, the initial removal of these impurities was somewhat higher in invention run 1.

While nitrogen removal was not measured, it is known that Catalyst D is effective for denitrogenation and it is believed that the addition of $Mo(CO)_6$ would also have a beneficial effect for denitrogenization in view of the improvement for desulfurization.

Figure 4:
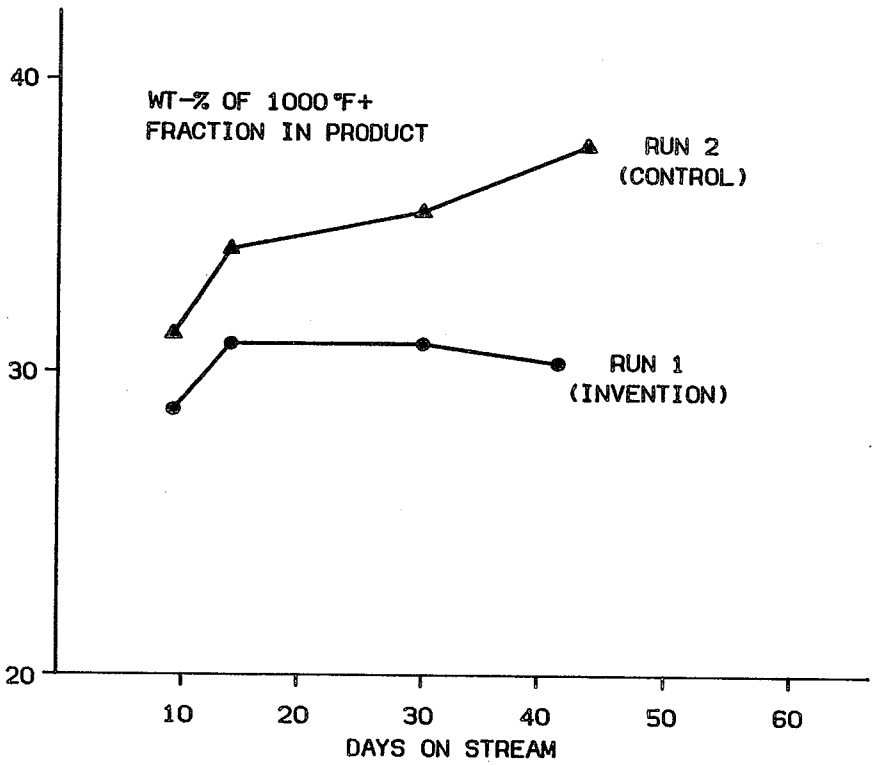

Another important parameter (not listed in Tables II and III) is the amount of undesirable heavies (the fraction having a boiling range higher than 1000° F.). FIG. 4 shows that in run 1 (with $Mo(CO)_6$ in the feed) the amount of undesirable heavies in the product was markedly lower (probably due to more extensive hydrocracking) than in control run 2.

EXAMPLE III

In the test described in this example 2000 ppm of Mo, as $Mo(CO)_6$, was added to an Arabian heavy crude oil (containing about 26 ppm Ni, 100 ppm V, 6 ppm Fe, 3.98 weight-% S and 11.5 weight-% Ramsbottom carbon residue), which was then hydrotreated essentially in accordance with the procedure described in Example I. The LHSV of the oil was 1.04–1.09 cc/cc catalyst/hr; pressure was 2,000 psig; hydrogen feed rate was 1.5 SCF per hour; temperature was 765° F. (407° C.); catalyst was fresh, presulfided Catalyst D.

This run (labled run 3) had to be terminated after about 20 hours because the reactor bed clogged up causing the feed flow to drop and the pressure to rise to unacceptable levels. After the cooled reactor was opened, the formed plug (apparently consisting of metals and coke) in the catalyst bed was removed by blowing it out with pressurized air.

In another similar run (labeled run 4), 360 ppm of Mo, as 990 ppm $Mo(CO)_6$, was added to the oil. The reactor bed in this run clogged after 48 hours. These runs demonstrate that high levels of Mo (360 ppm or above) should not be used.

It is also believed that lower concentrations of molybdenum above about 100 ppm would also exhibit the detrimental plugging effect.

EXAMPLE IV

In this example, the demetallizing effect of $Mo(CO)_6$ on the Arabian heavy crude described in Example III at different temperatures is described. The LHSV of the oil was varied at each temperature so as to achieve 92–93% sulfur removal; the hydrogen feed rate was 4800; the pressure was 2250; and the catalyst was fresh, presulfided Catalyst D. Pertinent test data for invention run 5 (15 ppm Mo as $Mo(CO)_6$ in the feed and control run 6 (no $Mo(CO)_6$ in the feed) are summarized in Table IV.

TABLE IV

| Temp. | Catalyst | Run 5 (Invention) % Removal | | | Run 6 (Control) % Removal | | |
|---|---|---|---|---|---|---|---|
| (°F.) | Age (Hrs) | of S | of V | of Ni | of S | of V | of Ni |
| 737 | 335 | 93 | 93 | 76 | — | — | — |
| 740 | 325 | — | — | — | 93 | 93 | 84 |
| 750 | 499 | 93 | 98 | 82 | — | — | — |
| 751 | 478 | — | — | — | 93 | 95 | 78 |
| 753 | 550 | — | — | — | 92 | 95 | 79 |
| 765 | 810 | 92 | 99.7 | 90 | — | — | — |

Data in Table IV show that, at a temperature of about 737°–740° F., there was essentially no difference in metal removal, at an equal sulfur removal level. However, in the temperature range of 750°–765° F., the removal of Ni and V was significantly higher in invention run 5.

EXAMPLE V

An Arabian heavy crude (containing about 30 ppm nickel and 102 ppm vanadium) was hydrotreated in accordance with the procedure described in Example I. The LHSV of the oil was 1.0, the pressure was 2250 psig, hydrogen feed rate was 4,800 standard cubic feet hydrogen per barrel of oil, and the temperature was 765° F. (407° C.). The hydrofining catalyst was fresh, presulfided catalyst D.

In run 7, no molybdenum was added to the hydrocarbon feed. In run 8, molybdenum (IV) octoate was added for 19 days. Then molybdenum (IV) octoate, which had been heated at 635° F. for 4 hours in Monagas pipe line oil at a constant hydrogen pressure of 980 psig in a stirred autoclave, was added for 8 days. For the final part of the run, molybdenum hexacarbonyl was added. In run 9, molybdenum hexacarbonyl was added to the hydrocarbon feed for 43 days and then the introduction of molybdenum was terminated. The results of run 7 are presented in Table V, the results of run 8 in Table VI, and the results of run 9 in Table VII.

TABLE V

| Days on Stream | PPM Mo in Feed | (Run 7) PPM in Product Oil Ni | V | Ni + V | % Removal of Ni + V |
|---|---|---|---|---|---|
| 1 | 0 | 13 | 25 | 38 | 71 |
| 2 | 0 | 14 | 30 | 44 | 67 |
| 3 | 0 | 14 | 30 | 44 | 67 |
| 6 | 0 | 15 | 30 | 45 | 66 |

TABLE V-continued

| Days on Stream | PPM Mo in Feed | (Run 7) PPM in Product Oil Ni | V | Ni + V | % Removal of Ni + V |
|---|---|---|---|---|---|
| 7 | 0 | 15 | 30 | 45 | 66 |
| 9 | 0 | 14 | 28 | 42 | 68 |
| 10 | 0 | 14 | 27 | 41 | 69 |
| 11 | 0 | 14 | 27 | 41 | 69 |
| 13 | 0 | 14 | 28 | 42 | 68 |
| 14 | 0 | 13 | 26 | 39 | 70 |
| 15 | 0 | 14 | 28 | 42 | 68 |
| 16 | 0 | 15 | 28 | 43 | 67 |
| 19 | 0 | 13 | 28 | 41 | 69 |
| 20 | 0 | 17 | 33 | 50 | 62 |
| 21 | 0 | 14 | 28 | 42 | 68 |
| 22 | 0 | 14 | 29 | 43 | 67 |
| 23 | 0 | 14 | 28 | 42 | 68 |
| 25 | 0 | 13 | 26 | 39 | 70 |
| 26 | 0 | 9 | 19 | 28 | 79 |
| 27 | 0 | 14 | 27 | 41 | 69 |
| 29 | 0 | 13 | 26 | 39 | 70 |
| 30 | 0 | 15 | 28 | 43 | 67 |
| 31 | 0 | 15 | 28 | 43 | 67 |
| 32 | 0 | 15 | 27 | 42 | 68 |

TABLE VI

| Days on Stream | PPM Mo in Feed | (Run 8) PPM in Product Oil Ni | V | Ni + V | % Removal of Ni + V |
|---|---|---|---|---|---|
| | | Mo (IV) octoate as Mo source | | | |
| 3 | 23 | 16 | 29 | 45 | 66 |
| 4 | 23 | 16 | 28 | 44 | 67 |
| 7 | 23 | 13 | 25 | 38 | 71 |
| 8 | 23 | 14 | 27 | 41 | 69 |
| 10 | 23 | 15 | 29 | 44 | 67 |
| 12 | 23 | 15 | 26 | 41 | 69 |
| 14 | 23 | 15 | 27 | 42 | 68 |
| 16 | 23 | 15 | 29 | 44 | 67 |
| 17 | 23 | 16 | 28 | 44 | 67 |
| 20 | | Changed to hydro-treated Mo (IV) octoate | | | |
| 22 | 23 | 16 | 28 | 44 | 67 |
| 24 | 23 | 17 | 30 | 47 | 64 |
| 26 | 23 | 16 | 26 | 42 | 68 |
| 28 | 23 | 16 | 28 | 44 | 67 |
| 29 | | Switched to $Mo(CO)_6$ as Mo source | | | |
| 30 | 16 | 14 | 23 | 37 | 72 |
| 31 | 16 | 13 | 18 | 31 | 77 |
| 32 | 16 | 12 | 17 | 29 | 78 |
| 35 | 16 | 13 | 18 | 31 | 77 |
| 37 | 16 | 12 | 17 | 29 | 78 |
| 39 | 16 | 12 | 17 | 29 | 78 |
| 42 | 16 | 12 | 17 | 29 | 78 |
| 43 | 16 | 13 | 18 | 31 | 77 |

TABLE VII

| Days on Stream | PPM Mo in Feed | (Run 9) PPM in Product Oil Ni | V | Ni + V | % Removal of Ni + V |
|---|---|---|---|---|---|
| 4 | 16 | 16 | 26 | 42 | 68 |
| 5 | 16 | 14 | 25 | 39 | 70 |
| 6 | 16 | 14 | 23 | 37 | 72 |
| 7 | 16 | 13 | 23 | 36 | 73 |
| 8 | 16 | 13 | 22 | 35 | 73 |
| 10 | 16 | 13 | 23 | 36 | 73 |
| 11 | 16 | 13 | 23 | 36 | 73 |
| 13 | 16 | 14 | 23 | 37 | 72 |
| 14 | 16 | 13 | 23 | 36 | 73 |
| 16 | 16 | 14 | 24 | 38 | 71 |
| 17 | 16 | 12 | 19 | 31 | 77 |
| 18 | 16 | 12 | 19 | 31 | 77 |
| 19 | 16 | 12 | 19 | 31 | 77 |
| 20 | 16 | 14 | 20 | 34 | 74 |
| 21 | 16 | 14 | 21 | 35 | 73 |
| 23 | 16 | 12 | 18 | 30 | 77 |
| 25 | 16 | 11 | 16 | 27 | 80 |

TABLE VII-continued

| Days on Stream | PPM Mo in Feed | (Run 9) PPM in Product Oil Ni | V | Ni + V | % Removal of Ni + V |
|---|---|---|---|---|---|
| 36 | 16 | 10 | 14 | 24 | 82 |
| 37 | 16 | 9 | 13 | 22 | 83 |
| 38 | 16 | 10 | 13 | 23 | 83 |
| 41 | 16 | 10 | 14 | 24 | 82 |
| 43 | 16 | 10 | 14 | 24 | 82 |
| 44 | | No Mo added. | | | |
| 45 | 0 | 9 | 10 | 19 | 86 |
| 49 | 0 | 9 | 11 | 20 | 85 |
| 53 | 0 | 10 | 12 | 22 | 83 |
| 55 | 0 | 12 | 17 | 29 | 78 |
| 56 | 0 | 11 | 14 | 25 | 81 |
| 57 | 0 | 11 | 14 | 25 | 81 |
| 58 | 0 | 12 | 17 | 29 | 78 |
| 63 | 0 | 10 | 14 | 24 | 82 |
| 65 | 0 | 12 | 17 | 29 | 78 |

Referring now to Tables V and VI, it can be seen that the percent removal of nickel plus vanadium remained fairly constant. No improvement was seen when untreated or hydro-treated molybdenum octoate was introduced in run 8. However, at day 29 when the molybdenum source was switched to molybdenum hexacarbonyl, it can be seen that a significant improvement occurred. Referring now to Table VII, the characteristic of the improvement of the present invention is demonstrated in the first 43 days. However, quite unexpectedly, when the addition of molybdenum was terminated at day 44, the metal removal did not drop immediately and indeed remained substantially constant for the remaining 21 days of the run. This demonstrates that periodic introduction of the molybdenum compound can be utilized after molybdenum has been added to the feed for a period of time.

It is not known how long the beneficial effects would persist or how long Mo must be added before periodic introduction can be commenced. However, it is clear that after 43 days Mo introduction can be terminated and there is no need to reintroduce Mo for at least 21 days.

EXAMPLE VI

This example illustrates that unsulfided and presulfided, fresh Catalyst D has approximately the same initial demetallizing activity in relatively short runs carried out essentially in accordance with the procedure of Example I. The feed was Monagas crude (without dissolved Molybdenum compounds). Pertinent process parameters and analytical results are summarized in Table VIII.

TABLE VIII

| Run[1] | LHSV (cc/cc/hr) | Temp. (°C.) | Catalyst | Run Time (Hours) | Feed Vanadium (ppm) | Feed Nickel (ppm) | Feed Ni + V (ppm) | Product Vanadium (ppm) | Product Nickel (ppm) | Product Ni + V (ppm) | Removal of Ni + V (%) |
|---|---|---|---|---|---|---|---|---|---|---|---|
| 10 | 1.51 | 425 | Unsulfided Catalyst D | 4.3 | 57 | 275 | 332 | 29 | 99 | 125 | 62 |
| 11 | 1.51 | 425 | Presulfided Catalyst D | 2.0 | 65 | 220 | 285 | 34 | 91 | 125 | 56 |
| 10 | 1.00 | 425 | Unsulfided Catalyst D | 3.0 | 57 | 275 | 332 | 25 | 81 | 106 | 68 |
| 11 | 1.00 | 425 | Presulfided Catalyst D | 2.3 | 65 | 220 | 285 | 17 | 40 | 57 | 80 |
| 10 | 1.51 | 400 | Unsulfided Catalyst D | 2.0 | 57 | 275 | 332 | 44 | 164 | 208 | 37 |
| 11 | 1.50 | 400 | Presulfided Catalyst D | 1.9 | 65 | 220 | 285 | 45 | 175 | 220 | 23 |
| 10 | 1.01 | 400 | Unsulfided Catalyst D | 3.0 | 57 | 275 | 332 | 39 | 134 | 173 | 48 |
| 11 | 1.02 | 400 | Presulfided Catalyst D | 2.5 | 65 | 220 | 285 | 42 | 132 | 174 | 39 |
| 10 | 0.48 | 400 | Unsulfided Catalyst D | 6.0 | 57 | 275 | 332 | 27 | 88 | 115 | 65 |
| 11 | 0.46 | 400 | Presulfided Catalyst D | 6.0 | 65 | 220 | 285 | 19 | 64 | 83 | 71 |

[1]Conditions were changed at the end of each specified Run Time and then the run was continued.

Even though the presulfided catalyst does not consistently outperform the unsulfided catalyst, as shown in Table VIII, presulfiding is still preferred since it is believed that performance over long runs will be enhanced by presulfiding.

EXAMPLE VII

This example illustrates the rejuvenation of substantially spent, sulfided, Catalyst D by the addition of $Mo(CO)_6$ to the feed, essentially in accordance with Example I except that the amount of Catalyst D was 10 cc. The feed was a supercritical Monagas oil extract containing about 28–35 ppm Ni, about 101–113 ppm V, about 3.0–3.2 weight-% S and about 5.0 weight-% Ramsbottom C. LHSV of the feed was about 5.0 cc/cc catalyst/hr; the pressure was about 2250 psig; the hydrogen feed rate was about 1000 SCF $H_2$ per barrel of oil; and the reactor temperature was about 775° F. (413° C.). During the first 600 hours on stream, no $Mo(CO)_6$ was present in the feed; thereafter $Mo(CO)_6$ was added. Results are summarized in Table IX.

TABLE IX

| Hours on Stream | Feed Added Mo(ppm) | Feed Ni (ppm) | Feed V (ppm) | Feed (Ni + V) (ppm) | Product Ni (ppm) | Product V (ppm) | Product (Ni + V) (ppm) | % Removal of (Ni + V) |
|---|---|---|---|---|---|---|---|---|
| 46 | 0 | 35 | 110 | 145 | 7 | 22 | 29 | 80 |
| 94 | 0 | 35 | 110 | 145 | 8 | 27 | 35 | 76 |
| 118 | 0 | 35 | 110 | 145 | 10 | 32 | 42 | 71 |
| 166 | 0 | 35 | 110 | 145 | 12 | 39 | 51 | 65 |

TABLE IX-continued

| Hours on Stream | Feed Added Mo(ppm) | Feed Ni (ppm) | Feed V (ppm) | Feed (Ni + V) (ppm) | Product Ni (ppm) | Product V (ppm) | Product (Ni + V) (ppm) | % Removal of (Ni + V) |
|---|---|---|---|---|---|---|---|---|
| 190 | 0 | 32 | 113 | 145 | 14 | 46 | 60 | 59 |
| 238 | 0 | 32 | 113 | 145 | 17 | 60 | 77 | 47 |
| 299 | 0 | 32 | 113 | 145 | 22 | 79 | 101 | 30 |
| 377 | 0 | 32 | 113 | 145 | 20 | 72 | 92 | 37 |
| 430 | 0 | 32 | 113 | 145 | 21 | 74 | 95 | 34 |
| 556 | 0 | 29 | 108 | 137 | 23 | 82 | 105 | 23 |
| 586 | 0 | 29 | 108 | 137 | 24 | 84 | 108 | 21 |
| 646 | 15 | 29 | 103 | 132 | 22 | 72 | 94 | 29 |
| 676 | 15 | 29 | 103 | 132 | 20 | 70 | 90 | 32 |
| 682 | 29 | 28 | 101 | 129 | 18 | 62 | 80 | 38 |
| 706 | 29 | 28 | 101 | 129 | 16 | 56 | 72 | 44 |
| 712 | 29 | 28 | 101 | 129 | 16 | 50 | 66 | 49 |
| 736 | 29 | 28 | 101 | 129 | 9 | 27 | 36 | 72 |
| 742 | 29 | 28 | 101 | 129 | 7 | 22 | 29 | 78 |
| 766 | 29 | 28 | 101 | 129 | 5 | 12 | 17 | 87 |

Data in Table show that the demetallization activity of a substantially spent or deactivated catalyst (removal of (Ni+V) after 586 hours: 21%) was dramatically increased (to about 87% removal of Ni+V) by Mo addition for about 120 hours (5 days). At the time when the Mo addition commenced, the deactivated catalyst had a metal (Ni+V) loading of about 34 weight-% (i.e., the weight of the fresh catalyst had increased by 34% due to the accumulation of metals). At the conclusion of the test run, the metal (Ni+V) loading was about 44 weight-%. Sulfur removal was not significantly affected by the addition of $Mo(CO)_6$.

Reasonable variations and modifications are possible within the scope of the disclosure in the appended claims to the invention.

That which is claimed is:

1. In a hydrofining process in which a hydrocarbon-containing feed stream is contacted under hydrofining conditions with hydrogen and a catalyst composition comprising a support selected from the group consisting of alumina, silica and silica-alumina and a promoter comprising at least one metal from Group VIB, Group VIIB, and Group VIII of the periodic table and in which said catalyst composition has been partially deactivated by use in said hydrofining process, a method for improving the activity of said catalyst composition for said hydrofining process comprising the step of adding a decomposable compound of molybdenum to said hydrocarbon-containing feed stream prior to contacting said hydrocarbon-containing feed stream with said catalyst composition, wherein the molybdenum in said decomposable compound is in a valence state of zero, wherein a sufficient quantity of said decomposable compound of molybdenum is added to said hydrocarbon-containing feed stream to result in a concentration of molybdenum in said hydrocarbon-containing feed stream in the range of about 1 to about 60 ppm and wherein said added decomposable compound was not added to said hydrocarbon-containing feed stream during the period of time that said catalyst composition was partially deactivated by said use in said hydrofining process.

2. A process in accordance with claim 1 wherein said decomposable compound of molybdenum is molybdenum hexacarbonyl.

3. A process in accordance with claim 1 wherein said catalyst composition is a substantially spent catalyst composition due to use in said hydrofining process.

4. A process in accordance with claim 1 wherein said catalyst composition comprises alumina, cobalt and molybdenum.

5. A process in accordance with claim 4 wherein said catalyst composition additionally comprises nickel.

6. A process in accordance with claim 1 wherein a sufficient quantity of said decomposable compound of molybdenum is added to said hydrocarbon-containing feed stream to result in a concentration of molybdenum in said hydrocarbon-containing feed stream in the range of about 2 to about 30 ppm.

7. A process in accordance with claim 1 wherein said hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

8. A process in accordance with claim 1 wherein said hydrofining conditions comprise a reaction time between said catalyst composition and said hydrocarbon-containing feed stream in the range of about 0.4 hours to about 4 hours, a temperature in the range of 350° C. to about 450° C., a pressure in the range of about 500 to about 3,000 psig and a hydrogen flow rate in the range of about 1,000 to about 6,000 standard cubic feet per barrel of said hydrocarbon-containing feed stream.

9. A process in accordance with claim 1 wherein the adding of said decomposable compound of molybdenum to said hydrocarbon-containing feed stream is interrupted periodically.

10. A process in accordance with claim 1 wherein said hydrofining process is a demetallization process and wherein said hydrocarbon-containing feed stream contains metals.

11. A process in accordance with claim 10 wherein said metals are nickel and vanadium.

* * * * *